US006724275B2

(12) United States Patent
Hasegawa

(10) Patent No.: US 6,724,275 B2
(45) Date of Patent: Apr. 20, 2004

(54) NONRECIPROCAL CIRCUIT DEVICE AND COMMUNICATION APPARATUS

(75) Inventor: Takashi Hasegawa, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 56 days.

(21) Appl. No.: 10/138,880

(22) Filed: May 3, 2002

(65) Prior Publication Data

US 2002/0167371 A1 Nov. 14, 2002

(30) Foreign Application Priority Data

May 11, 2001 (JP) ..... 2001-142457

(51) Int. Cl.[7] ..... H01P 1/32; H01P 1/36
(52) U.S. Cl. ..... 333/1.1; 333/24.2
(58) Field of Search ..... 333/1.1, 24.2

(56) References Cited

U.S. PATENT DOCUMENTS 5,223,805 A * 6/1993 Talcott et al. ..... 333/1.1
5,620,543 A * 4/1997 Marusawa et al. ..... 156/89.12
5,945,887 A * 8/1999 Makino et al. ..... 333/1.1
6,462,628 B2 * 10/2002 Kondo et al. ..... 333/24.2
6,512,424 B2 * 1/2003 Furuya et al. ..... 333/1.1

* cited by examiner

*Primary Examiner*—Michael Tokar
*Assistant Examiner*—Linh V Nguyen
(74) *Attorney, Agent, or Firm*—Keating & Bennett, LLP

(57) ABSTRACT

A nonreciprocal circuit device includes a resin case, and external terminals insert-molded with the resin case when the resin case is molded, so as to project from the resin case. The resin case is provided with concavities each formed in a bottom face of the resin case and enclosing a position at which each external terminal projects. During insert molding, any excess resin is absorbed by the concavities, whereby the resin is prevented from being applied to bottom faces of the external terminals.

15 Claims, 10 Drawing Sheets

NONRECIPROCAL CIRCUIT DEVICE AND COMMUNICATION APPARATUS

BACKGROUND OF THE INVENTION

1. Field of the Invention

The present invention relates to nonreciprocal circuit devices and communication apparatuses using the devices. In particular, the present invention relates to a nonreciprocal circuit device, such as an isolator or a circulator, which is used in a microwave band, and to a communication apparatus using the device.

2. Description of the Related Art

FIGS. 10, 11, 12A and 12B show a lumped-constant-type isolator (nonreciprocal circuit device) for use in a mobile communication apparatus, such as a cellular phone, including a resin case 1, a center-electrode assembly 10 including a ferrite 11 and center electrodes 12*a*, 12*b*, and 12*c*, a permanent magnet 15, a resistor 16, matching capacitors 17, and metallic cases 18 and 19, as shown in FIGS. 10 and 11. In FIG. 12A, the resin case 1 is provided with external input-output terminals 5 and external grounding terminals 6 as metallic insert parts (a lead frame) being embedded at both sides of the bottom of the resin case 1 when the resin case 1 is molded.

Each of the external terminals 5 or 6 of the reciprocal circuit device projects from the bottom of the resin case 1 by a projection amount Y (see FIG. 12B). The projection amount Y tends to become smaller as the nonreciprocal circuit device is reduced in size and becomes low-profile. In recent years, the projection amount Y has been on the order of 0 to 100 $\mu$m.

As the projection amount Y is reduced, as described above, a mismatch between the lead frame and a mold causes a phenomenon in that the resin partly covers the external terminals. In FIG. 12A, excess resin 1*a* is seen partially covering the external input-output terminal 5 disposed at the right side.

When the projection amount Y is large, the excess resin 1*a* does not reach the bottom face of the external input-output terminal 5 and does not affect mounting of the nonreciprocal circuit device. However, when the projection amount Y is small, the excess resin 1*a* reaches the bottom face of the external input-output terminal 5, thereby causing a harmful effect on the mounting of the device. That is, when mounting, the external input-output terminal 5 and an electrode formed on the circuit board cannot be soldered to each other, whereby electrical connection becomes open, or even when these can be soldered to each other, the strength of connection is not sufficient, thereby reducing reliability. Such a problem can be solved by increasing the projection amount Y. However, it is not practical to increase the projection amount Y because it is desirable for the device to be reduced in size and also to be low-profile.

Also, the resin flows into the notches that are provided for cutting the device from a lead frame, the notches being formed in connecting parts of the lead frame, which causes a problem in which burrs of the resin are produced when the lead frame is cut at the connecting parts, whereby the device cannot be reliably mounted.

SUMMARY OF THE INVENTION

It is an object of the present invention to provide a nonreciprocal circuit device and a communication apparatus using the nonreciprocal circuit device in which resin can be prevented from being applied to bottom faces of external terminals during insert molding and which can be reduced in size and be low-profile, whereby the nonreciprocal circuit device can be reliably mounted.

It is another object of the present invention to provide a nonreciprocal circuit device and a communication apparatus using the nonreciprocal circuit device in which resin can be prevented from flowing into notches formed in connecting parts of a lead frame during insert molding, whereby the nonreciprocal circuit device can be reliably mounted.

To these ends, according to an aspect of the present invention, a nonreciprocal circuit device comprises a resin case; and external terminals insert-molded with the resin case so as to project from the resin case when the resin case is molded. The resin case is provided with concavities each formed in a bottom face of the resin case and in the vicinity of a position from which each external terminal projects.

With this arrangement, when the external terminals of the nonreciprocal circuit device are insert-molded with the resin case and excess resin is supplied, the oversupplied resin is absorbed by the concavities formed in the bottom face of the resin case and is not applied to the bottom faces of the external terminals. Therefore, reliable soldering can be performed so as to have sufficient joint strength even when the projection amount of the external terminals is reduced so that the size of the nonreciprocal circuit device is reduced and becomes low-profile, and solder fillets can be formed in excellent shapes. Moreover, since the external terminals and electrodes of a mounting substrate can be reliably brought into contact with each other, insertion loss can be reduced. When the external terminals and the electrodes of the mounting substrate are not brought into contact with each other, they come into contact with each other only via solder which has high resistance, thereby increasing the insertion loss.

According to another aspect of the present invention, a nonreciprocal circuit device comprises a resin case; and external terminals which are formed with a lead frame and are insert-molded with the resin case when the resin case is molded. The resin case is provided with concavities each formed in a bottom face of the resin case, and in the vicinity of a notch formed in each of connecting parts which are formed with the lead frame and are insert-molded with the resin case when the resin case is molded.

When the connecting parts of the lead frame of the nonreciprocal circuit device according to the present invention are insert-molded with the resin case, the resin flowing toward the notches formed in the connecting parts is absorbed by the concavities which are formed in the bottom face of the resin case, and does not flow into the notches, whereby burrs of the resin are prevented from being produced when the connecting parts are cut at the notches.

Each of the concavities, which are formed in the bottom face of the resin case, preferably has a depth of 0.01 to 0.1 millimeters. When the concavities are excessively deep, the joint strength between the resin case and the external terminals or connecting parts is reduced. When the concavities are excessively shallow, the resin flowing toward the notches cannot be sufficiently absorbed by the concavities.

A material for the resin case preferably comprises one of liquid crystal polymer, polyphenylene sulfide, and polyetheretherketone, which are heat-resistive and are low-loss materials. The material for the external terminals may comprise as a major component one of iron, brass, and phosphor bronze, which are easily bent.

According to another aspect of the present invention, a communication apparatus comprises the above-described nonreciprocal circuit device.

The nonreciprocal circuit device according to the present invention is provided with concavities each formed in the vicinity of the external terminals projecting from the bottom of the resin case or in the vicinity of the notches formed in the connecting parts of the lead frame. Therefore, the resin is absorbed by the concavities when the resin case is molded, whereby the resin does not cover the bottom faces of the external terminals or does not flow into the notches of the connecting parts.

Therefore, reliable soldering of the external terminals having sufficient joint strength can be performed without increasing the projection amount of the external terminals, thereby permitting a reduction of size and a low-profile feature. The nonreciprocal circuit device can be reliably mounted without producing burrs of the resin when the connecting parts of the lead frame are cut at the notches.

A reliable communication apparatus is obtainable by being provided with the nonreciprocal circuit device having the above advantages.

Other features and advantages of the present invention will become apparent from the following description of embodiments of the invention which refers to the accompanying drawings.

DESCRIPTION OF EMBODIMENTS OF THE INVENTION

A nonreciprocal circuit device and a communication apparatus using the nonreciprocal circuit device according to embodiments of the present invention are described below with reference to the attached drawings.

Figure 1A:
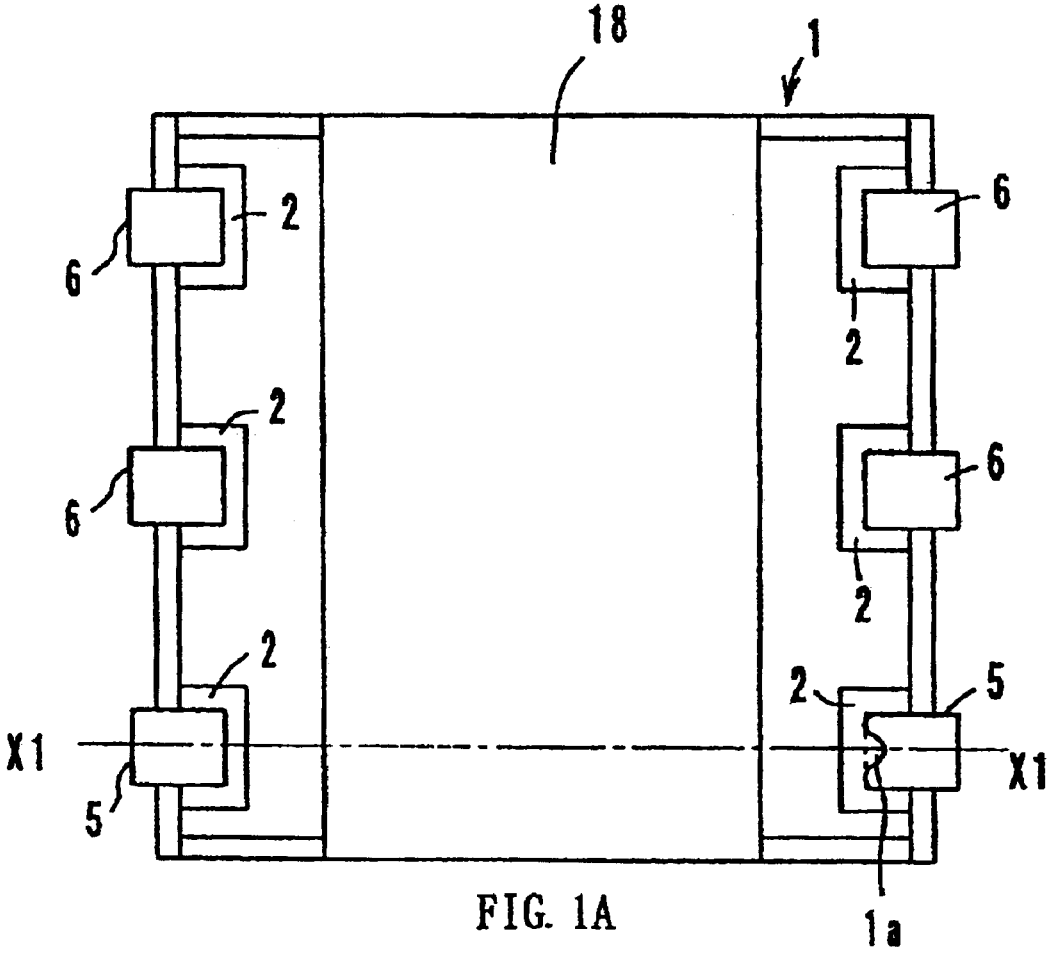
FIG. 1A is a bottom view of a nonreciprocal circuit device according to a first embodiment of the present invention.
Figure 1B:
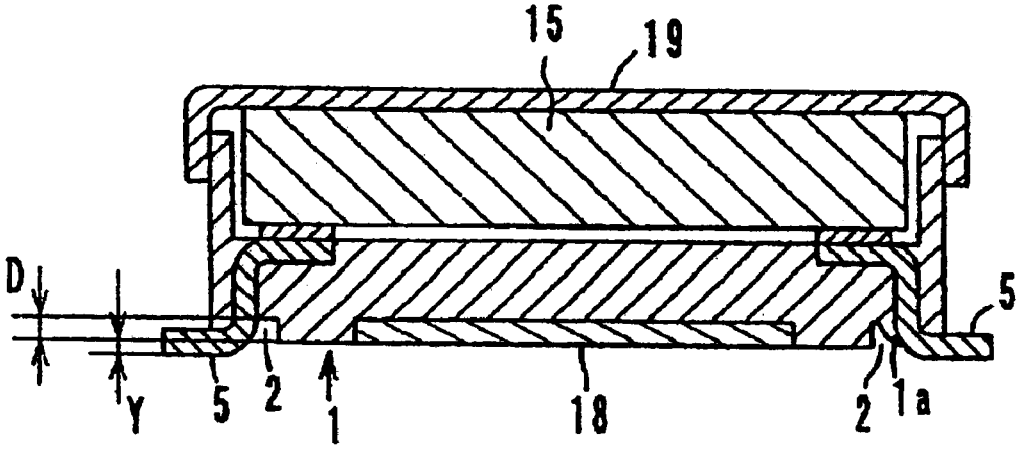
FIG. 1B is a sectional view along line X1—X1 of the nonreciprocal circuit device shown in FIG. 1A.
Figure 2:
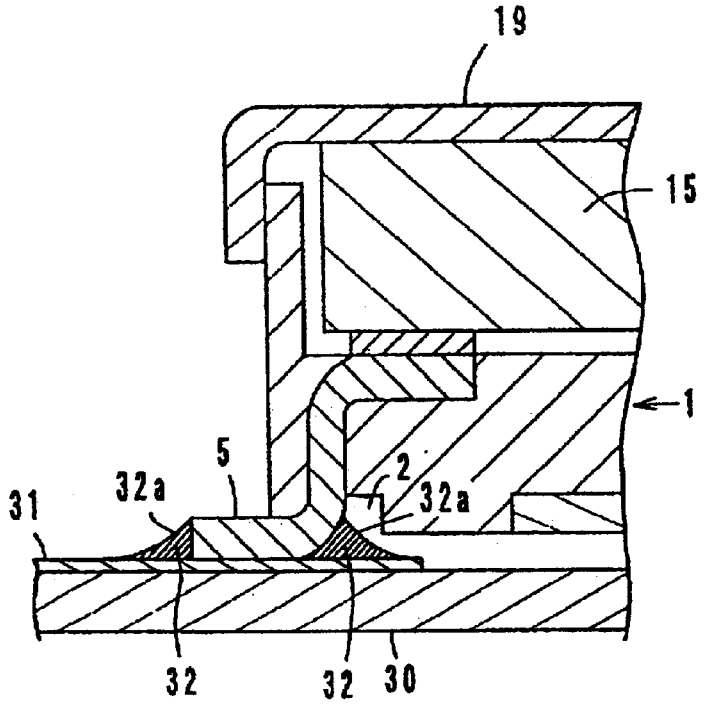
FIG. 2 is a partly expanded view of the nonreciprocal circuit device according to the first embodiment.

First Embodiment (see FIGS. 1A, 1B, and 2)

FIG. 1A is a bottom view of a nonreciprocal circuit device (a lumped-constant-type isolator) according to a first embodiment of the present invention. FIG. 1B is a sectional view along line X1—X1 of the nonreciprocal circuit device shown in FIG. 1A. Components of the nonreciprocal circuit device shown in FIGS. 1A and 1B being the same as those of the known nonreciprocal circuit device shown in FIGS. 10, 11, 12A, and 12B are referred to with the same reference numerals, for which description is omitted. The components of a nonreciprocal circuit device according to second, third and fourth embodiments described below are referred to with the same reference numerals as those of the nonreciprocal circuit device according to the first embodiment.

The nonreciprocal circuit device according to the first embodiment is provided with concavities 2 formed in a bottom face of a resin case 1, individually enclosing external terminals 5 and 6. The external terminals 5 and 6 are insert-molded with the resin case 1 so as to project from the resin case 1. The concavities 2 are formed when insert molding.

A material for the resin case 1 is preferably heat-resistive and is a low-loss material; a liquid crystal polymer, polyphenylene sulfide, or polyetheretherketone is suitable for the material for the resin case 1. The concavities 2 serve to prevent the bottom faces of the external terminals 5 and 6 from being covered with the resin when insert-molded. Even when excess resin 1*a* (see FIG. 1B) is supplied, the excess resin 1*a* does not reach the bottom face of the external terminal 5 or 6 and the excess resin 1*a* is absorbed by the concavities 2.

The depth of each concavity 2 is relative to a projection amount Y of each of the external terminals 5 and 6. When the depth of the concavity 2 is excessively large, the joint strength between the external terminals 5 and 6 and the resin case 1 is reduced. When it is excessively small, the resin covers the bottom of the external terminal 5 or 6. Therefore, the depth of the concavity 2 is preferably 0.01 to 0.1 mm. In the first embodiment, a depth D of each concavity 2 is set to 0.05 mm while the projection amount Y of each of the external terminals 5 and 6 is set to 0.02 mm.

A material for the external terminals 5 and 6 preferably includes as a major component iron, brass, or phosphor bronze, which can be easily bent. The external terminals 5 and 6 are generally plated with silver having a thickness in the order of 1 to 10 m for reducing insertion loss and easy soldering. Copper or nickel is plated, as a primary coat, on the substrate and under the silver plating so that the strength of the silver plating is increased.

Since the concavities 2 are formed individually around the external terminals 5 and 6 at the bottom face of the resin case 1, the resin does not reach the bottom face of each external terminal 5 or 6, as it is absorbed by the concavity 2 during insert molding. Therefore, when the nonreciprocal circuit device is mounted to a circuit board 30 (see FIG. 2), it is possible to avoid the problems of an electrical connection becoming open, or of the joint strength being reduced due to defective soldering between the external terminal 5 or 6 and an electrode 31 formed on the circuit board 30. Moreover, mounting strength is increased because solder fillets 32*a* are formed in excellent shapes, as shown in FIG. 2.

When solder 32 is excessively applied, the concavities 2 can also absorb the solder 32, thereby avoiding so-called solder balls. That is, the amount of solder applied for mounting is less critical, so mounting can be performed more easily.

Figure 3:
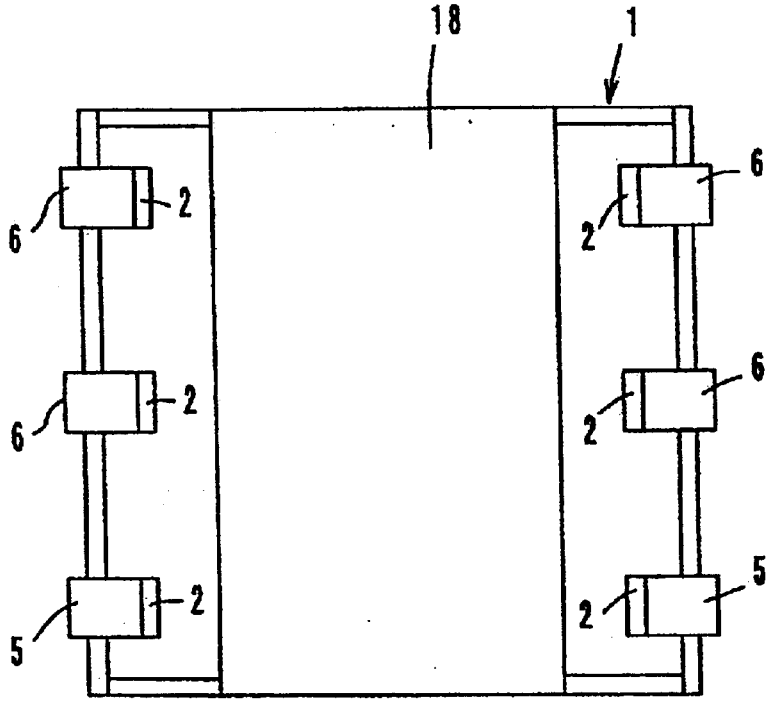
FIG. 3 is a bottom view of a nonreciprocal circuit device according to a second embodiment.

Second Embodiment (see FIG. 3)

FIG. 3 is a bottom view of a nonreciprocal circuit device (a lumped-constant-type isolator) according to a second embodiment of the present invention, the section thereof being the same as that shown in FIG. 1B.

According to the second embodiment, the concavities 2 are formed only at positions opposing respective end faces of the external terminals 5 and 6. The concavities 2 are not necessarily formed so as to enclose the entire external terminals 5 and 6. The concavities 2 may be only formed at the positions, such as at round portion which is round angle area and its periphery of the external terminal 5 and 6 according to the second embodiment, at which fitting in with a mold and a lead frame 20 is difficult because the round portion has round angle. The nonreciprocal circuit device according to the second embodiment offers the same advantages as those of the first embodiment.

Third Embodiment (see FIGS. 4 to 7C)

Figure 4:
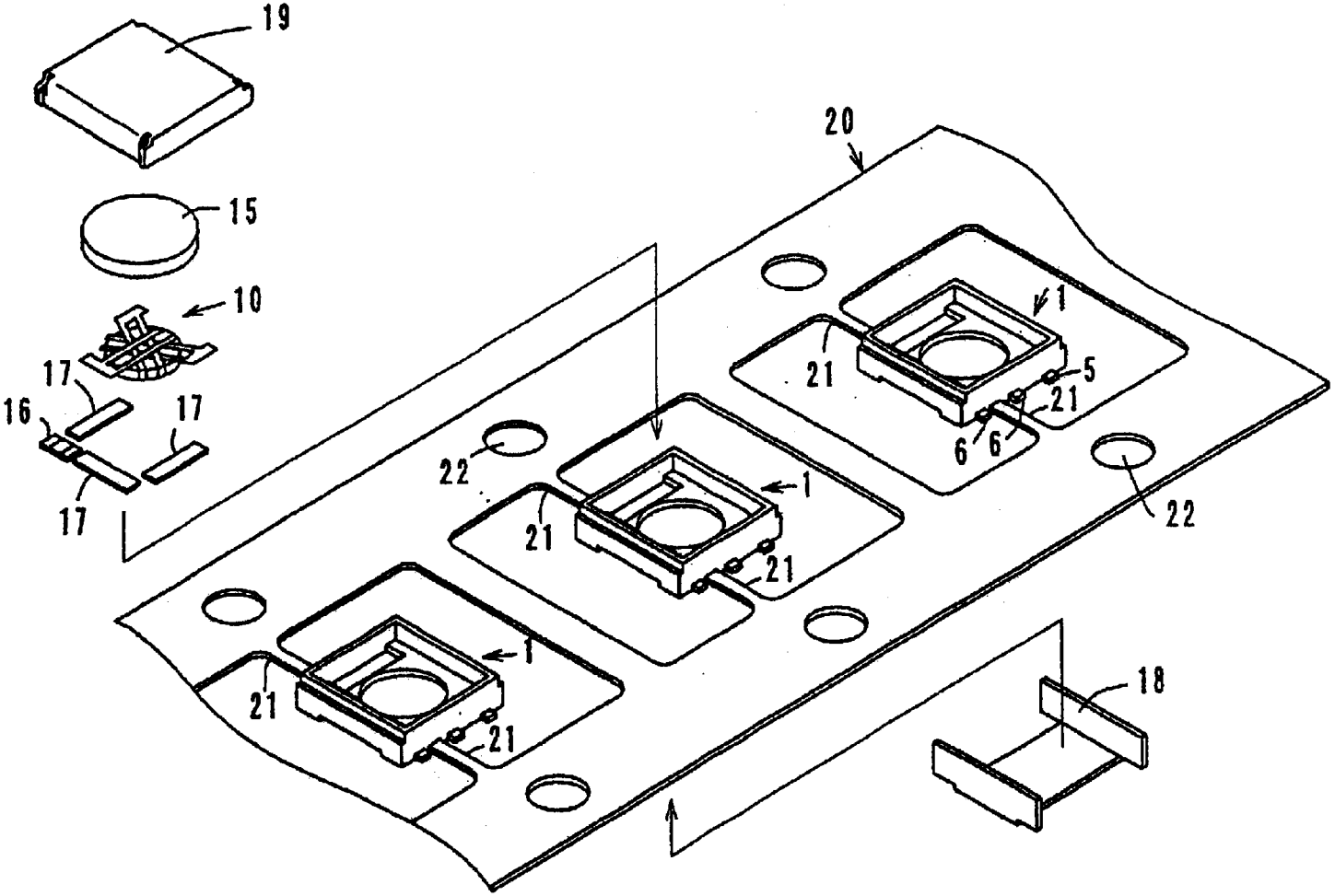
FIG. 4 is a perspective view showing a manufacturing process of a nonreciprocal circuit device according to a third embodiment of the present invention.
Figure 5:
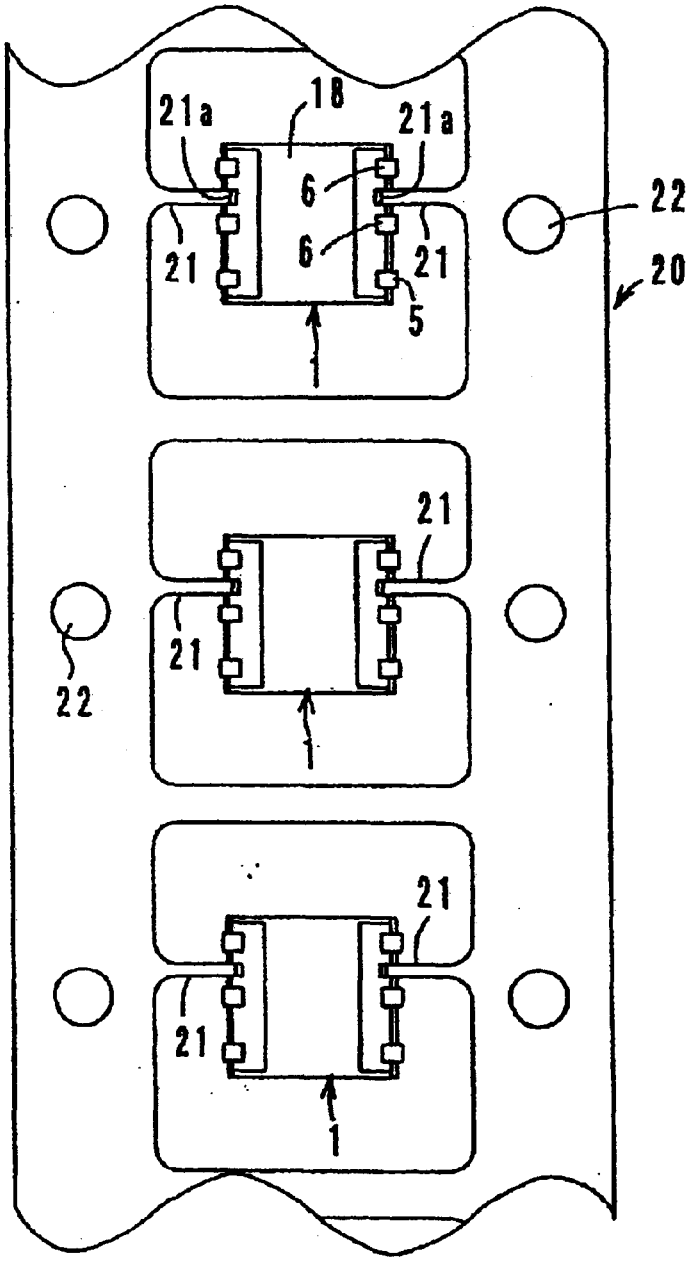
FIG. 5 is a bottom view showing the manufacturing process of the nonreciprocal circuit device according to the third embodiment.

FIGS. 4 and 5 show a manufacturing process of a nonreciprocal circuit device (a lumped-constant-type isolator) according to a third embodiment of the present invention. External terminals 5 and 6 and connecting parts 21 formed in a lead frame 20 are insert-molded when the resin case 1 is molded. The lead frame 20, which is a conventional lead frame, serves to transfer the resin cases 1 stepwise one by one for automatically forming the nonreciprocal circuit devices and is provided with pilot holes 22 for controlling the transfer.

The external terminals 5 and 6 are connected with the connecting parts 21. Firstly they are insert-molded after plating. Secondly they are separated from the lead frame 20, and the connecting parts 21 are cut away from the lead frame 20 after components of the nonreciprocal circuit device are assembled into the resin case 1. A material for the lead frame 20 is preferably the same as that for the external terminals 5 and 6, according to the first embodiment.

The connecting parts 21 are used for making the insert-molded products. And it is very efficient to assemble the non-reciprocal circuit easily to use the connecting parts 21 in the assembling process.

Figure 6:
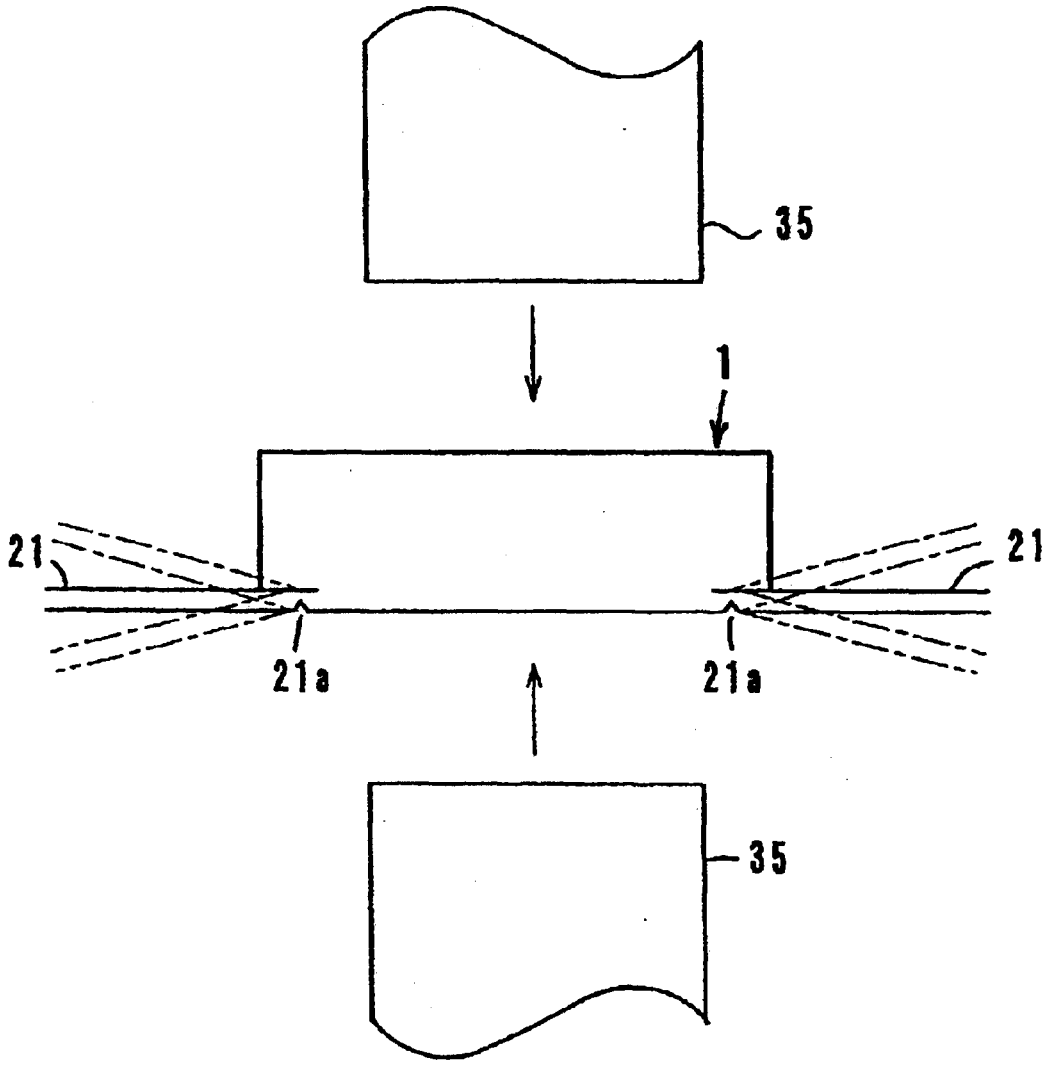
FIG. 6 is an illustration in which a lead frame is cut at a connecting part thereof during a manufacturing process of the nonreciprocal circuit device according to the third embodiment.

A notch 21*a* is formed in the bottom face of each connecting part 21 of the lead frame 20, as shown in FIGS. 5 and 6. After the nonreciprocal circuit devices are formed, the connecting parts 21 are bent so as to break away from each resin case 1 at the notches 21*a* while the resin case 1 is held by upper and lower press bars 35.

Figure 7C:
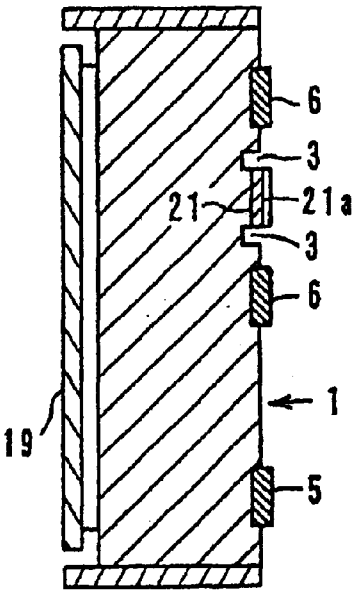
FIGS. 7B and 7C are sectional views along line X2—X2 and along line X3—X3, respectively, of the nonreciprocal circuit device shown in FIG. 7A.
Figure 7A:
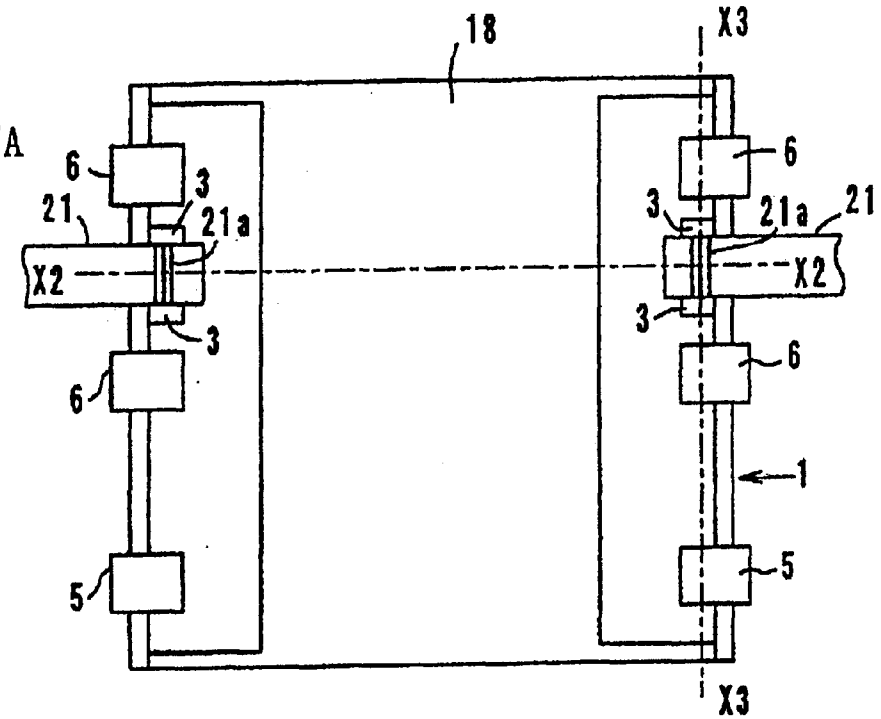
FIG. 7A is a bottom view of the nonreciprocal circuit device according to the third embodiment.
Figure 7B:
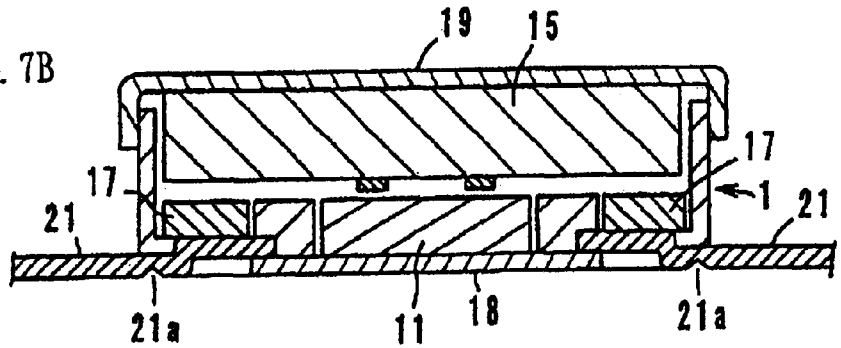

According to the third embodiment, concavities 3 respectively opposing the two ends of the notch 21*a* of each connecting part 21 are formed in the bottom face of the resin case 1 when being insert-molded, as shown in FIGS. 7A, 7B and 7C.

The concavities 3 serve to absorb the resin to prevent it from flowing into the notches 21*a* during insert molding. By preventing the resin from flowing into the notches 21*a*, the production of burrs of the resin when the connecting parts 21 are cut away at the notches 21*a* can be avoided. Since no burrs of the resin are produced, the problems are overcome; that is, the electrical connection between the nonreciprocal circuit device and a circuit board is not obstructed by burrs of the resin therebetween when the nonreciprocal circuit device is mounted to the circuit board, and the solder joint strength is not reduced.

Figure 8:
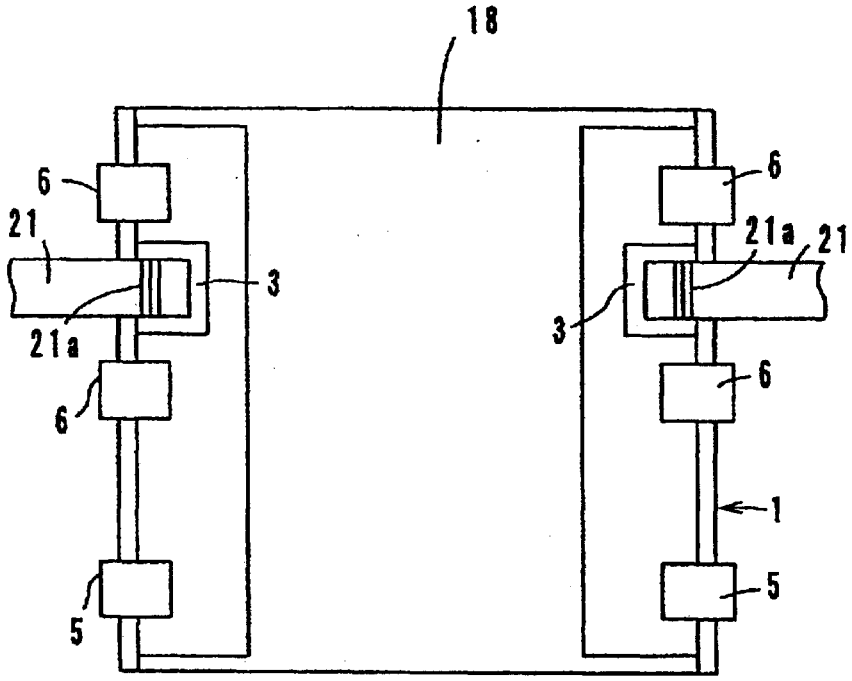
FIG. 8 is a bottom view of a nonreciprocal circuit device according to a fourth embodiment of the present invention.

Fourth Embodiment (see FIG. 8)

FIG. 8 is a bottom view of a nonreciprocal circuit device (a lumped-constant-type isolator) according to a fourth embodiment of the present invention. The sections of the nonreciprocal circuit device are similar to those which are shown in FIGS. 7B and 7C.

According to the fourth embodiment, concavities 3 are formed not only at the ends of the notches 21*a*, but also at positions where they enclose the portions of the bottom face of the resin case 1 from which the connecting parts 21 are led out. The nonreciprocal circuit device according to the fourth embodiment offers the same advantages as those of the nonreciprocal circuit device according to the third embodiment.

Figure 9:
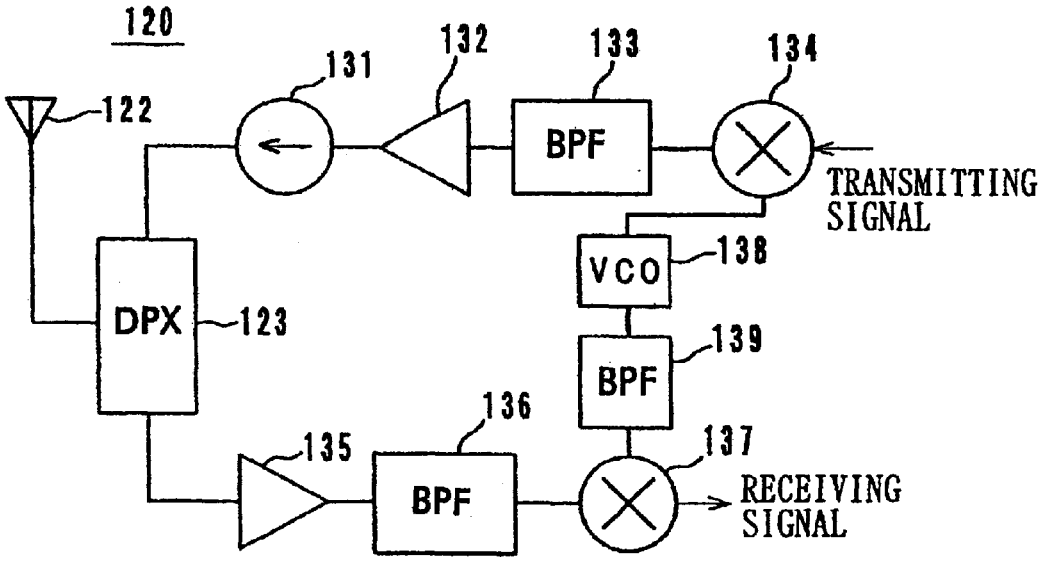
FIG. 9 is a block diagram of an electrical circuit of a communication apparatus (a cellular telephone) according to the present invention.
Figure 10:
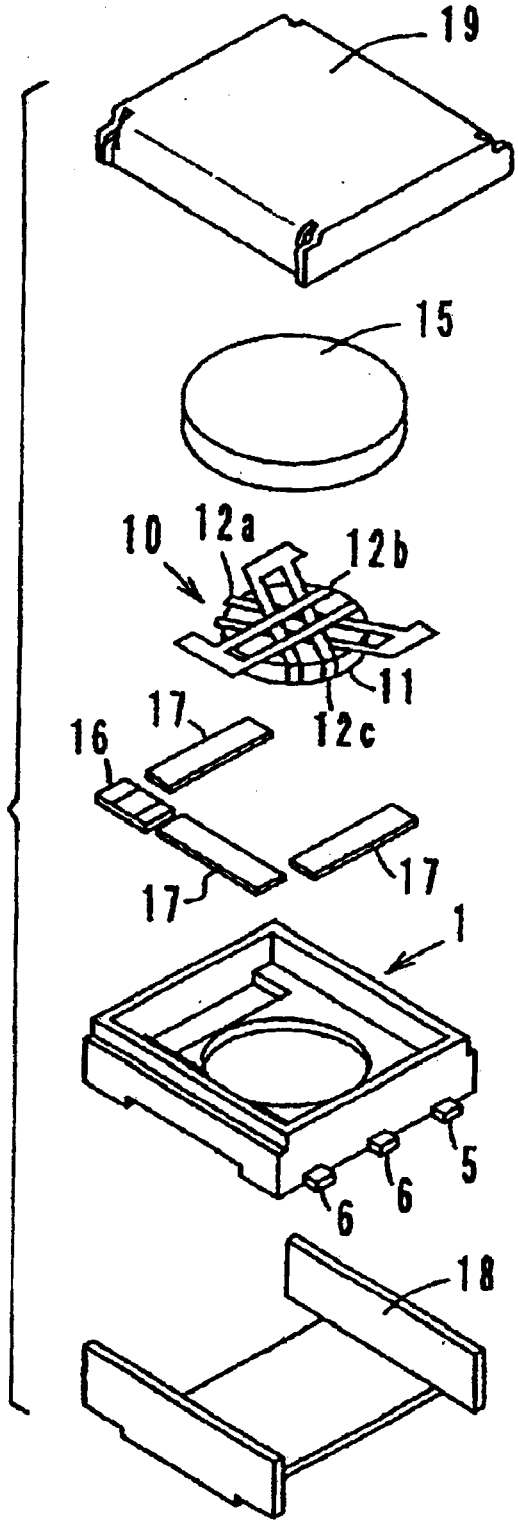
FIG. 10 PRIOR ART
FIG. 10 is an exploded perspective view of a known nonreciprocal circuit device.
Figure 11:
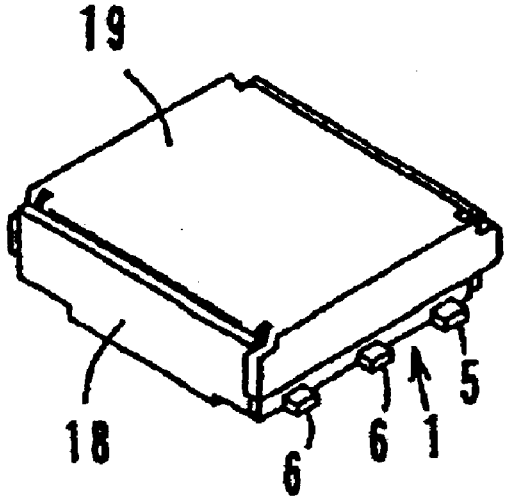
FIG. 11 PRIOR ART
FIG. 11 is a perspective view of the known nonreciprocal circuit device.
Figure 12A:
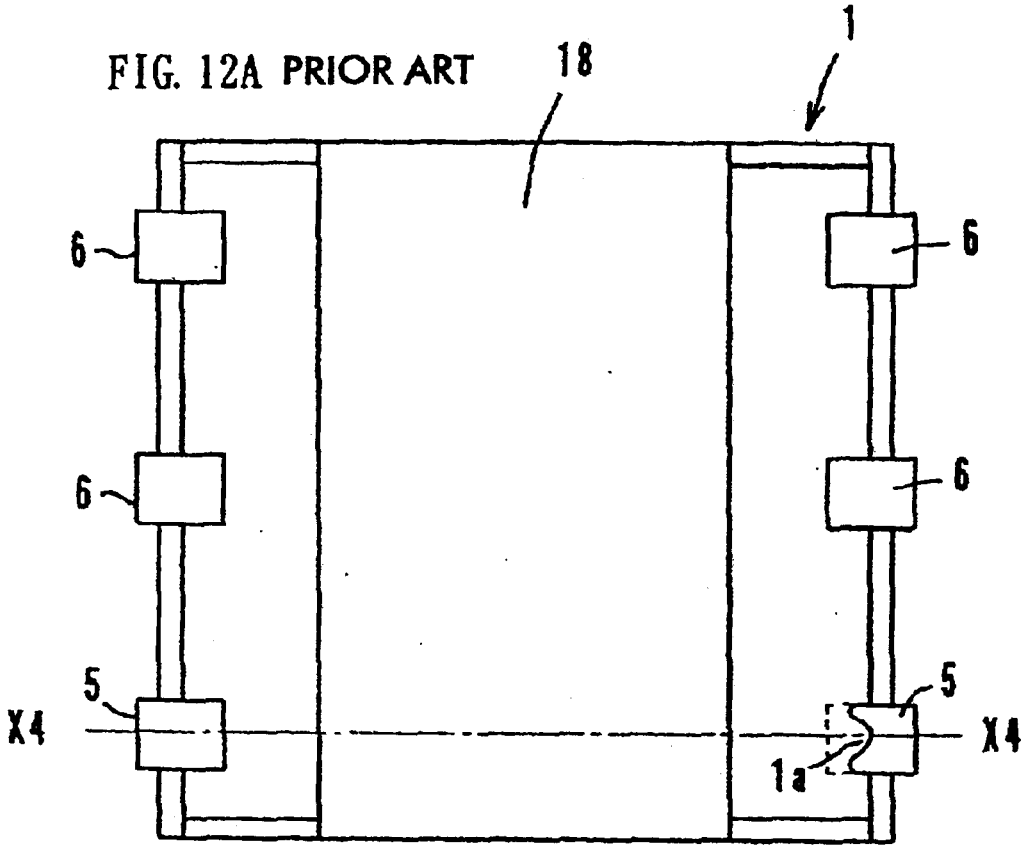
FIG. 12A PRIOR ART
FIG. 12A is a bottom view of the known nonreciprocal circuit device.
Figure 12B:
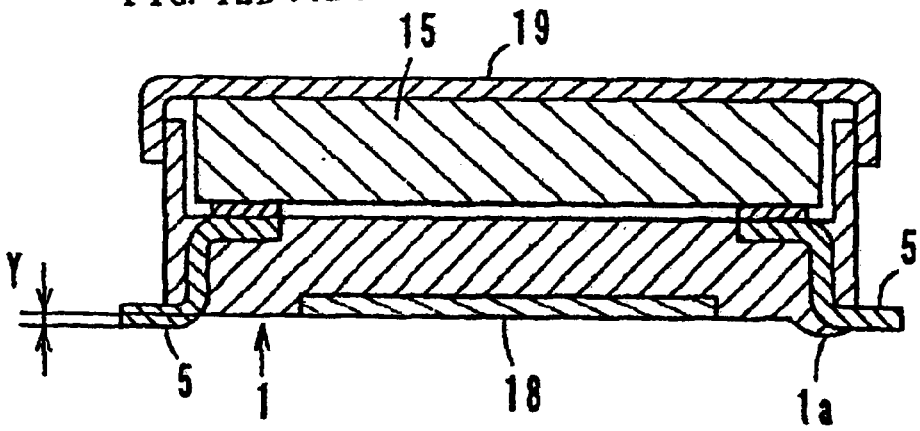
FIG. 12B PRIOR ART
FIG. 12B is a sectional view along line X4—X4 of the known nonreciprocal circuit device shown in FIG. 12A.

Communication Apparatus (see FIG. 9)

A cellular telephone as a communication apparatus according to another embodiment of the present invention is described below. FIG. 9 is a block diagram of an electrical circuit 120 in an RF-part of the cellular telephone. FIG. 9 shows an antenna 122, a duplexer 123, a transmitting isolator 131, a transmitting amplifier 132, a transmitting section-band-pass filter 133, a transmitting mixer 134, a receiving amplifier 135, a receiving section-band-pass filter 136, a receiving mixer 137, a voltage control oscillator (VCO) 138, and a local band pass filter 139.

In the cellular telephone, the nonreciprocal circuit device (a lumped-constant-type isolator) according to the first to fourth embodiments can be used as the transmitting isolator 131. A cellular telephone which has the advantages of reliable soldering with sufficient joint strength can be realized by using such a nonreciprocal circuit device.

Other Embodiments

The nonreciprocal circuit device and the communication apparatus according to the present invention are not limited to the above embodiments, and may be modified within the scope and spirit of the present invention.

Such components as the center electrode assembly, the permanent magnet, and the case which form the nonreciprocal circuit device may have any shape or configuration. The nonreciprocal circuit device according to the present invention may be a circulator.

Although the present invention has been described in relation to particular embodiments thereof, many other variations and modifications and other uses will become apparent to those skilled in the art. Therefore, the present invention is not limited by the specific disclosure herein.

What is claimed:

1. A nonreciprocal circuit device comprising:

a resin case; and external terminals insert-molded with the resin case so as to project from a bottom face of the resin case when the resin case is molded; wherein the resin case is provided with at least one concavity, each concavity corresponding to a respective one of said external terminals and formed in the bottom face of the resin case at a position from which the corresponding external terminal projects; and the at least one concavity provides a space between the bottom surface of the resin case and the external terminals.

2. A nonreciprocal circuit device comprising:

a resin case; and external terminals which are formed from connecting parts of a lead frame insert-molded with the resin case when the resin case is molded, a notch being formed in each of the connecting parts adjacent to a bottom face of the resin case;

wherein the resin case is provided with at least one concavity each corresponding to a respective one of said external terminals and formed in the bottom face of the resin case at the position of the corresponding one of said notches.

3. A nonreciprocal circuit device according to claim 1 or 2, wherein each of the concavities has a depth of 0.01 to 0.1 millimeters.

4. A nonreciprocal circuit device according to claims 1 or 2, wherein each of said external terminals projects from said bottom face by a distance of 0.02 mm.

5. A nonreciprocal circuit device according to claim 4, wherein each of the concavities has a depth of 0.01 to 0.1 millimeters.

6. A nonreciprocal circuit device according to claim 1 or 2, wherein each of the concavities has a depth of 0.05 millimeters.

7. A nonreciprocal circuit device according to claim 1 or 2, wherein a material for the resin case is selected from the group consisting of liquid crystal polymer, polyphenylene sulfide, and polyetheretherketone.

8. A nonreciprocal circuit device according to claim 1 or 2, wherein a material for the external terminals is selected from the group consisting of iron, brass, and phosphor bronze as a principal constituent.

9. A communication apparatus comprising:

a nonreciprocal circuit device according to claim 1 or 2, said nonreciprocal circuit device being connected in one of a transmitting circuit and a receiving circuit.

10. A method of manufacturing a nonreciprocal circuit device comprising the steps of:

insert-molding external terminals with a resin case so that the external terminals project from a bottom face of the resin case when the resin case is molded, and providing the resin case with concavities, each concavity corresponding to a respective one of said external terminals and formed in the bottom face of the resin case at a position from which the corresponding external terminal projects; and the concavities provide a space between the bottom surface of the resin case and the external terminals.

11. A method of manufacturing a nonreciprocal circuit device comprising the steps of:

insert-molding resin ease with connecting parts of a lead frame to form external terminals in the resin case when the resin case is molded, a notch being formed in each of the connecting parts adjacent to a bottom face of the resin case, and providing the resin case with concavities, each corresponding to a respective one of said external terminals and formed in the bottom face of the resin case at the position of the corresponding one of said notches.

12. A method according to claim 10 or 11, wherein each of the concavities has a depth of 0.01 to 0.1 millimeters.

13. A method according to claim 10 and or 11, wherein each of said external terminals projects from said bottom face by a distance of 0.02 mm.

14. A method according to claim 13, wherein each of the concavities has a depth of 0.01 to 0.1 millimeters.

15. A method according to claim 10 or 11, wherein each of the concavities has a depth of 0.05 millimeters.

* * * * *